US005896772A

United States Patent [19]

Izumi

[11] Patent Number: 5,896,772

[45] Date of Patent: Apr. 27, 1999

[54] EXTRUDER

[75] Inventor: Isao Izumi, Yamaguchi, Japan

[73] Assignee: Ube Industries, Ltd., Ube, Japan

[21] Appl. No.: 09/026,171

[22] Filed: Feb. 19, 1998

[51] Int. Cl.[6] ..... B21C 27/00

[52] U.S. Cl. ..... 72/272; 72/273

[58] Field of Search ..... 72/270, 272, 273, 72/273.5, 342.2

[56] References Cited

U.S. PATENT DOCUMENTS

| | | | |
|---|---|---|---|
| 5,392,628 | 2/1995 | Cristiani | 72/272 |
| 5,445,004 | 8/1995 | Nannini et al. | 72/272 |
| 5,461,899 | 10/1995 | Sorheim et al. | 72/272 |
| 5,613,393 | 3/1997 | Bessey | 72/272 |
| 5,678,442 | 10/1997 | Ohba et al. . | |

*Primary Examiner*—Joseph J. Hail, III
*Assistant Examiner*—Ed Tolan
*Attorney, Agent, or Firm*—Kanesaka & Takeuchi

[57] ABSTRACT

An extruder is formed of a container having a container liner for receiving a billet therein, an extrusion stem situated near the container for disposing the billet into the container, and a two-piece seal block installed between the container and the extrusion stem for sealing therebetween. The seal block is formed of two seal block sections for sandwiching the extrusion stem therebetween. Each seal block section includes a base piece having a press member, and a holding block detachably attached to the base piece to be moved by the press member and having a first sealing member facing the extrusion stem and a second sealing member facing the container. A moving device is attached to the seal block sections for moving the seal block sections relative to the extrusion stem. The holding block is urged to the extrusion stem by the moving device, and to the container by the press member to thereby seal between the container and the extrusion stem.

6 Claims, 18 Drawing Sheets

EXTRUDER

FIELD OF THE INVENTION AND RELATED ART

The present invention relates to an extruder, used for extruding materials such as aluminum alloy by an extrusion press, which can eliminate air trapped between a container and a billet to the outside of the container after a fixed dummy block or an extrusion stem is closed by a two-piece seal block and before the billet is extruded, thereby providing an end product without a blow hole of air and reducing the time.

After a billet the diameter of which is slightly smaller than the inner diameter of a container is inserted into the container, the billet is pressed against a die with an extruding stem from the rear side of the container which is called as "upsetting" so that the billet is pressed to be deformed to compress air trapped between the container and the billet. For eliminating the compressed air, the extruding stem and the container are slightly backed to release the compressed air to the atmosphere from a space between the die and the container. After that, the extrusion is started by advancing the container and the extruding stem to the original positions. The deaeration step for eliminating compressed air as mentioned above is referred to as a "verp cycle" which causes a waste of time in the extrusion cycle.

Moreover, this process remains air in a small space like a film at atmospheric pressure between the inner surface of the container and the outer surface of the billet when the container is pressed against the die after the deaeration of the verp cycle. That is, the sufficient deaeration can not be obtained by this process. This may produce blisters in an extruded product. Such an extruded product including blisters should be removed, thereby reducing the yield of end products.

Therefore, there is a method as disclosed in JPB S48-25315 to enable residual air to be easily and securely eliminated for extrusion of a billet. In this process, the residual air is eliminated by providing metallic bellows to form a sealed chamber between a container and an extruding stem, sealing by metallic packing between one end of the bellows and the container and between the other end and the extruding stem by metallic packing, and pressing the metallic packing from the outside by a cylinder using air or fluid to eliminate air in the sealed chamber to the outside.

Further, JPA S52-47556 discloses a method of vacuum deaeration from a container through a space between a dummy block and the container with the inside of the container being sealed with sealing material, through a supporting member being sealingly in contact with disc-like supporting plates, arranged in suitable positions of an extruding stem with carbon sealing material, elastically by a spring disposed between the rear wall of the container and the supporting plates.

Furthermore, JPB (utility) S55-19605 discloses an extruder provided with a two-piece seal block allowed to open and close in a direction perpendicular to the axial direction of a container. In this extruder, the inner surface of the seal block comes into close contact with the outer surface of an extruding stem when the seal block closes.

Such a two-piece seal block opens and closes along a guide plate fixed to upper and lower portions of an end face of the container at the extruding stem side. In addition, sealing members for sealing the container from the extruding stem are arranged between a cover plate and the seal block and between the extruding stem and the inner surface of the seal block, respectively. The container is provided with a deaerating groove at an upper portion thereof at the extruding stem side, thereby facilitating deaeration.

Moreover, JPA H5-245533 discloses a device comprising a rim, coming into contact with an end face of a container at an extruding stem side, and an elastic member of telescopic type sealed by edges thereof which are slidable against the extruding stem to keep a hermetically sealed enclosure to be pressed against the end face of the container over the full stroke of the extruding press device. Air within the container is vacuumed after sealed by bringing the rim into contact with the end face of the container by stretching the elastic member of the telescopic type.

In addition, there is an extruder as disclosed in U.S. Pat. No. 5,678,442 which is provided with a two-piece seal block allowed to open and close in a direction perpendicular to the axial direction of a container so that a sealing member comes into close contact with the outer surface of a ring-like projection fixed to the container and the outer surface of an extruding stem at the same time when the seal block closes.

The structures disclosed in JPB S48-25315, JPA S52-47556, JPA H5-245533, and U.S. Pat. No. 5,678,442 have following problems.

(1) Since the flexible sealing device such as a metallic bellows, a spring, or an elastic member of telescopic type, which is expandable from the extruding stem side toward the rear end of the container, is used to seal the container to completely eliminate the residual air in the container for the extrusion of the billet, it necessitates a larger deaerating space and a longer deaerating time, and the atmosphere is easily entered into the container because of insufficient sealing thereby causing the degree of vacuum lower.

(2) The sealing device is backed to a ram (a base portion of the extruding stem) side during loading the billet into the container and then the inside of the container is sealed by advancing the sealing device after the billet is completely loaded by the forward movement of the extruding stem so as to vacuum air in the container, thereby making the idle time longer for the operation of the sealing device.

(3) Since the flexible sealing device is stretched from the backmost position of the base of the extruding stem to the end face of the container, the front portion of the seal device is deformed due to the dead weight so as to make a space between the end face of the container and the seal device, thereby deteriorating the sealing performance.

(4) It needs large pressure to press the sealing device from the ram side to the container so that the container comes in sufficiently contact with the end face of the container, thereby making the structure complex.

(5) In a condition that the flexible sealing device is compressed at the backmost position, the extruding press device is longer than the conventional extruding stem (conventionally, the extending stem necessitates a length sufficiently for extruding the billet loaded in the container) for the size of the sealing device in the compressed state, thereby increasing the whole length of the extruding press and thus necessitating a wider area for installing the extruding press.

(6) According to JPA S52-47556 or JPA H05-245533, the sealing device moves relatively to the extruding stem with the sealing device being always in contact with the extruding stem, thereby easily wearing sealing materials and the contact surfaces between the sealing device and the extruding stem and decreasing their lives.

(7) In the case of (6), the front portion of the sealing device is deformed due to the dead weight, so that the sealing device easily interferes with the extruding stem, thereby further decreasing there lives.

There are following problems related to JPB (utility) S55-19605.

(8) The two-piece seal block opens and closes along the guide plate disposed on the end face of the container. The sealing members disposed between the seal block and the guide plate receive heat from the container during opening and closing of the seal block, and is exposed to high temperature (for example more than 300° C.) by holding heat in air heated in the container and moreover rubs against the guide plate, therefore significantly deteriorating the sealing members and decreasing the lives.

(9) When the extruding stem is backed to the original position after completion of extrusion of the billet, for scrapping off aluminum residues stuck to the inner surface of the container liner by the outer surface of the fixed dummy block fixed to the end of the extruding stem, the scrapped aluminum residues enter into a groove of the guide plate so that the seal block is difficult to open and close, thereby deteriorating sealing performance.

(10) Since a deaerating groove is formed in the inner surface of the container, i.e. the upper portion of the inner surface of the container liner at the extruding stem side, such a container is not allowed to be used in a general purpose extruder because of the limitation so that the container liner must be exchanged with another one without deaerating groove whenever used for another purpose, thereby taking a lot of time for exchanging container liners.

(11) The container liner is exerted with large external force during upsetting the billet so that a portion where the deaerating groove is formed is exerted with concentrated load, thereby decreasing the mechanical strength.

(12) There are many kinds of sealing methods previously improved. One of the most recently known methods is disclosed in U.S. patent application Ser. No. 656,523. In this method, a container and an extruding stem separately move relative to each other and a two-piece seal block is attached to the container. An outer sealing member of a ring-like projection and an stem sealing member are both integrally fixed to the two-piece seal block to seal the container and the stem in the same direction, respectively. Therefore, a minute space may be generated in a portion sealed by one of the sealing members so that the sealing members can not come in sufficient contact with the container or the stem, thereby making sealing performance lower.

OBJECT AND SUMMARY OF THE INVENTION

The present invention is achieved in consideration of the problems of prior art as mentioned above. It is an object of the present invention to completely eliminate air within a container by sealing the container before extruding a billet out of a die, thereby providing an extruding cycle without a step of deaerating before extruding the billet from a die, called as the verp cycle, and providing an extruder which can prevent the inclusion of air into the billet and thus prevent the deterioration of the quality and yield of end products.

For achieving the objects mentioned above, according to a first aspect, an extruder comprises an end face, at an extruding stem side, of a container having a container liner in which a billet is loaded; a two-piece seal block allowed to be opened or closed in a direction perpendicular to the axial direction of the extruding stem; and a press member. When the seal block is closed, the seal block is brought sealingly in contact with the end face of the container and the outer surface of the extruding stem simultaneously by sealing members fixed to the seal block. The press member is arranged to be moved in a direction of pressing the sealing members of the seal block against the end face of the container.

According to a second aspect, the seal block comprises base pieces and sealing material holding blocks and the sealing material holding blocks are capable of performing vacuum aspiration by engaging to a fixed dummy block or the extruding stem and is arranged slidably in the lateral direction and detachably relative to said base pieces. The sealing material holding blocks are fixed to the base pieces with engaging pins each having a stopping plate which is engaged to an engaging portion by turning the stopping plate.

The billet in the container is pressed from the rear side against the die by the extruding stem so that the billet is squeezed and air trapped between the container and the billet is compressed. The compressed air must be vacuumed form the rear side of the container before the billet is extruded from the die. In addition, air must be vacuumed from the container just before the end of the billet comes into contact with the die. According to the present invention, the air in the container is forcibly vacuumed at the extruding stem side before the billet is compressed by the extruding stem, thereby omitting the step for eliminating compressed air after the billet is compressed by the extruding stem, called as a breathing process.

Air in the container is vacuumed with the container being sealed by the seal block having a press member arranged to press the seal block against the end face of the container at the extruding stem side. For smoothly removing the air in the container, container is provided with a ring-like deaerating groove at the entrance thereof at the extruding stem side, the diameter of which is greater than that of the fixed dummy block, so that a ring-like space is formed between the inner surface of the container and the outer surface of the fixed dummy block when the billet is loaded into the container. Therefore, air trapped between the container and the billet can be easily eliminated to the outside of the container, thereby preventing the inclusion of blister and thus significantly improving the yield of the end products.

Moreover, according to the present invention, the extruding stem is sealed around the outer surface thereof while the container is sealed at the end face in the traveling direction of the extruding stem so that the end face of the container is sealed by friction force between the extruding stem and the sealing materials, thereby further ensuring the seal contact.

Since the seal block and the sealing material holding blocks are formed as separate parts and loosely fixed to each other, the sealing material holding blocks can be sealingly in contact corresponding to any misalignment of the container and the extruding stem. As a result of this, the degree of vacuum is improved so as to be 30 Torr or less, thereby preventing the inclusion of blister in an extruded product.

DESCRIPTION OF THE PREFERRED EMBODIMENTS

Hereinafter, an embodiment of an extruder according to the present invention will be described with reference to the attached drawings.

Figure 1:
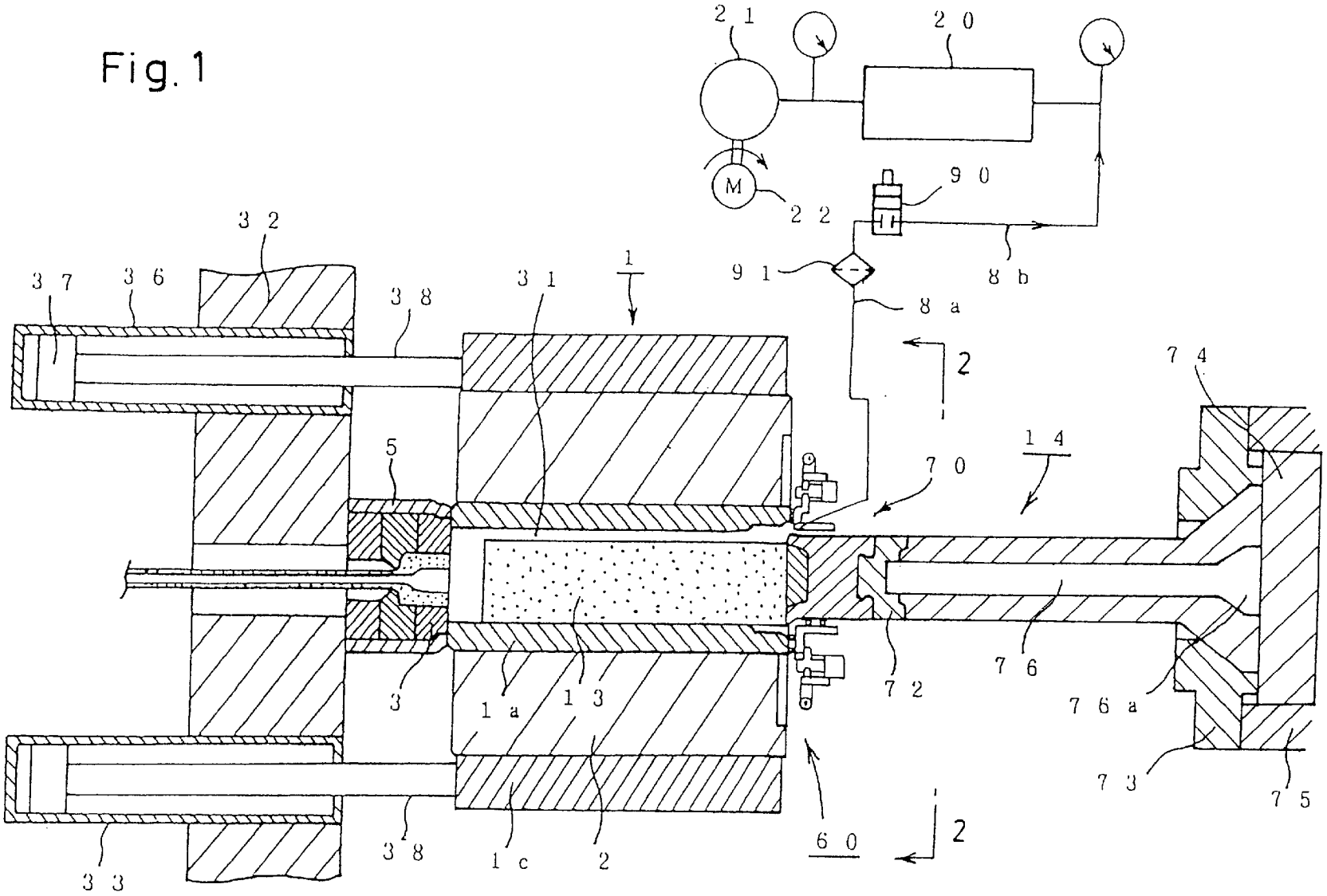
FIG. 1 is a system diagram of one preferred embodiment according to the present invention.

As shown in FIG. 1, an end platen 32 is provided with container cylinders 33 for allowing the sliding of a container 1 comprising a container liner 1*a,* a container tier 2, and a container holder 1*c*. Reference numeral 36 designates a cylinder tube which is a part of a cylinder body, 37 designates a piston, and 38 designates a piston rod.

A die 3 is inserted and held in a die ring 5 in such a manner that the die 3 can slide to the inner surface of the die ring 5. Reference numeral 31 designates a space, as a deaeration space to be deaerated, between the inner surface of the container and the outer surface of a billet 13.

An extruding stem 14 for extruding the billet 13 is provided with a fixed dummy block 70 at the tip end thereof which can be in close contact with the inner surface of the container 1.

The description will now be made as regard to a vacuum aspirator 60 for aspirating residual air from the deaeration space 31.

Figure 2:
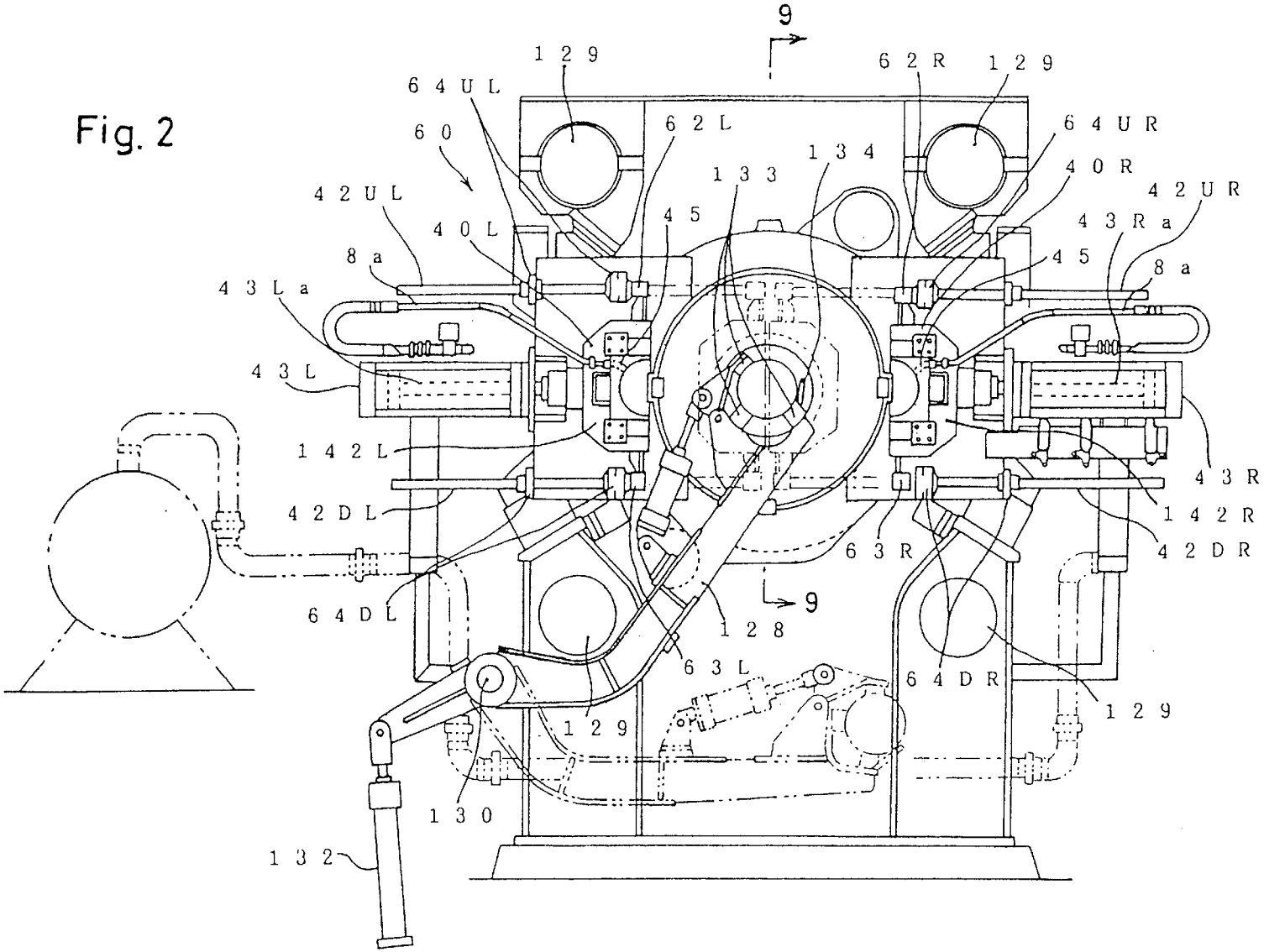
FIG. 2 is a view taken along a line 2—2 of FIG. 1.
Figure 3:
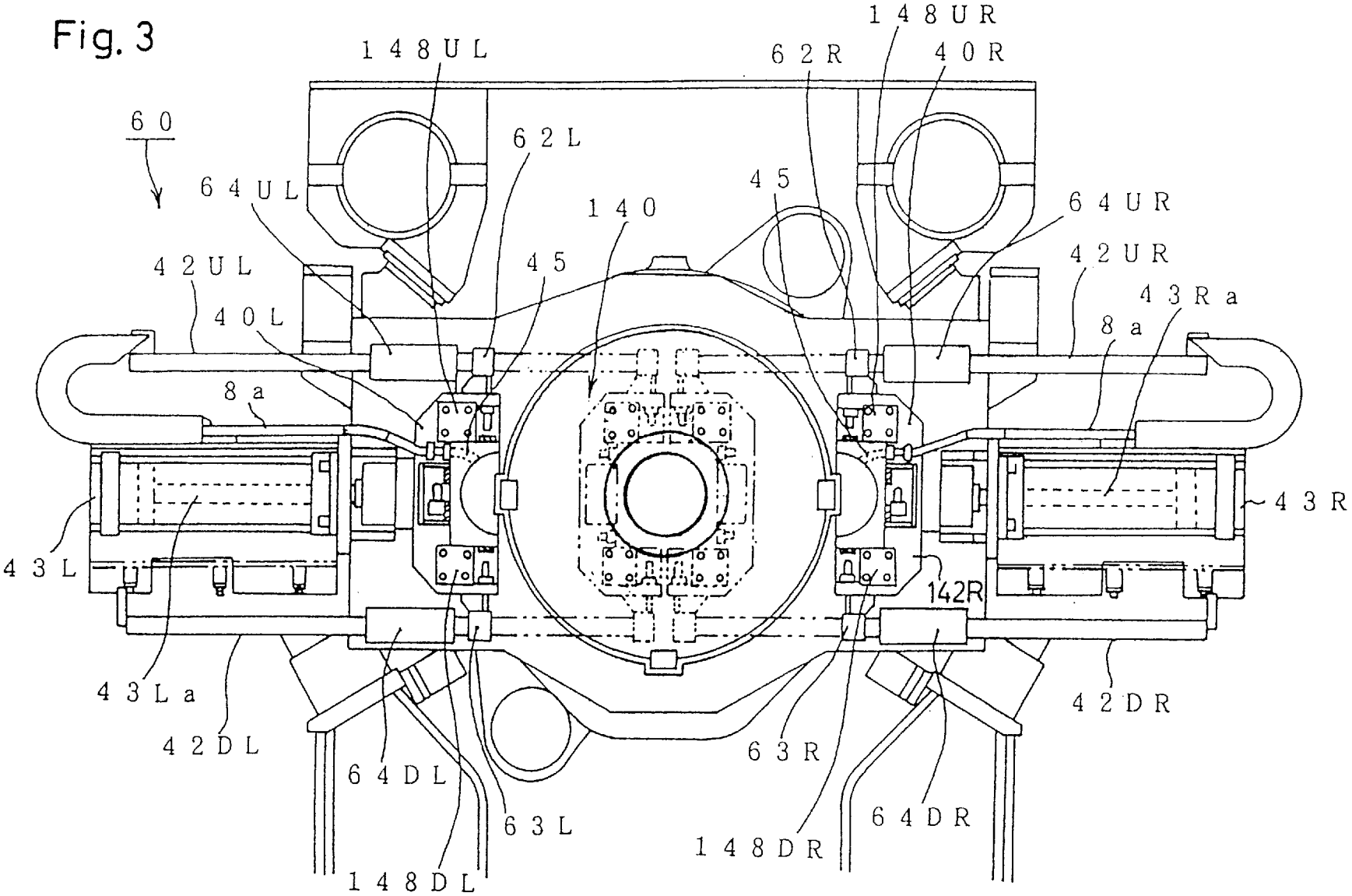
FIG. 3 is an enlarged partial view of FIG. 2.
Figure 4:
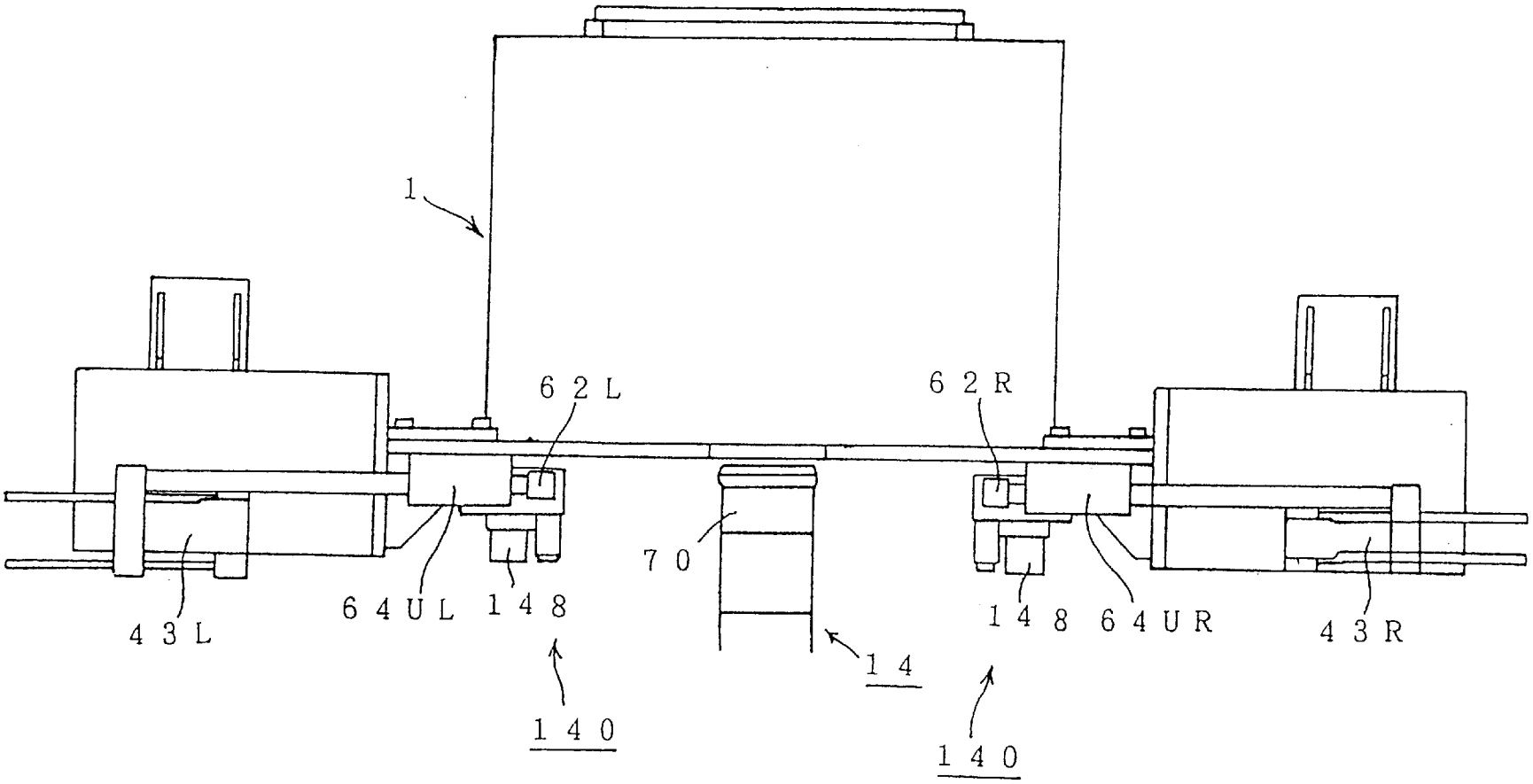
FIG. 4 is a plan view of a container provided with a two-piece seal block.

The vacuum aspirator 60 for deaerating the deaeration space 31 from the extruding stem 14 side in the container 1 has a seal block which is the combination of two seal block pieces 40R and 40L arranged on the end face of the container 1 at the extruding stem 14 side. The seal block as the combination of the seal block pieces 40R and 40L has a substantially square shape as shown in FIGS. 2 and 3 and has an opening of substantially the same diameter as the extruding stem 14 at the center thereof. The rear ends of the seal block pieces 40R and 40L are fixed to tips of piston rods 43Ra and 43La of cylinders 43R and 43L, respectively.

According to the stroke of the piston rods 43Ra and 43La, the seal block pieces 40R and 40L move in a direction perpendicular to the axial direction of the container 1 along guide rods 42UR, 42UL and 42DR, 42DL which are disposed above and below the seal block.

The seal block pieces 40R and 40L are provided with upper guide legs 62R and 62L disposed above the seal block pieces, respectively. The guide rods 42UR and 42UL are fixed to upper guide legs 62R, 62L, respectively. Through pipes 64UR and 64UL are slidably inserted onto the guide rods 42UR and 42UL, respectively.

The seal block pieces 40R and 40L are also provided with lower guide legs 63R and 63L disposed beneath the seal block pieces, respectively. The guide rods 42DR and 42DL are fixed to the lower guide legs 63R and 63L, respectively. Through pipes 64DR and 64DL are slidably inserted onto the guide rods 42DR and 42DL, respectively. The through pipes 64UL and 64DL function for the seal block piece 40L while the through pipes 64UR and 64DR function for the seal block piece 40R.

Figure 6A:
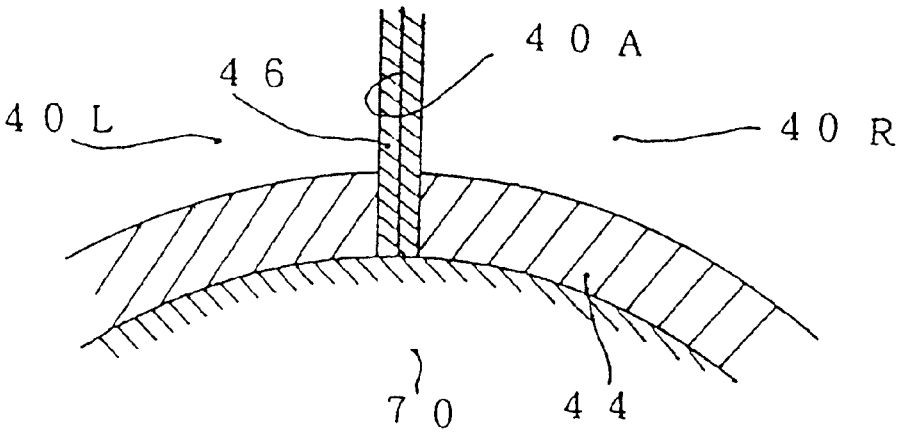
FIGS. 6*a* and 6*b* are views illustrating comparison between a case of seal block pieces in which both surfaces are glued with sealing materials, respectively and a case without sealing materials.

For preventing air infiltration between the contact surfaces 40A of the seal block pieces 40R and 40L when the seal block pieces 40R and 40L come in contact with each other i.e. the seal block is closed, the contact surfaces 40A are provided with sealing members 46 (sheet-like sealing materials) attached thereon as shown in FIG. 6*a*.

For example, the sealing members 46 are preferably sponge-like sealing materials, having heat resistance and resiliency, made of silicon rubber or fluoro-rubber.

When the seal block is closed, the sealing members 46 attached to the contact surfaces 40A of the seal block pieces 40R and 40L come in sealing contact with each other. As shown in FIGS. 9 through 12*a* and 12*b,* sealing members 41 disposed on the surfaces of the seal block pieces 40R, 40L at the container 1 side come in sealing contact with the end face 51 of the container liner 1*a* and sealing members 44 come into sealing contact with an outer surface of the fixed dummy block 70 or the extruding stem 14.

The sealing members 41 and 44 are preferably made of heat resistant and high deformable material, such as relatively hard string-like silicone rubber and string-like fluoro-rubber. Though the sealing members 41 and 44 are each disposed doubly, not single, with a space therebetween as shown in FIGS. 9 through 12*a* and 12*b* in order to prevent air infiltration from the outside during the vacuum aspiration, the invention is not limited thereto so that the sealing members may be each disposed triply or more, thereby providing perfect deaeration.

Figure 6B:
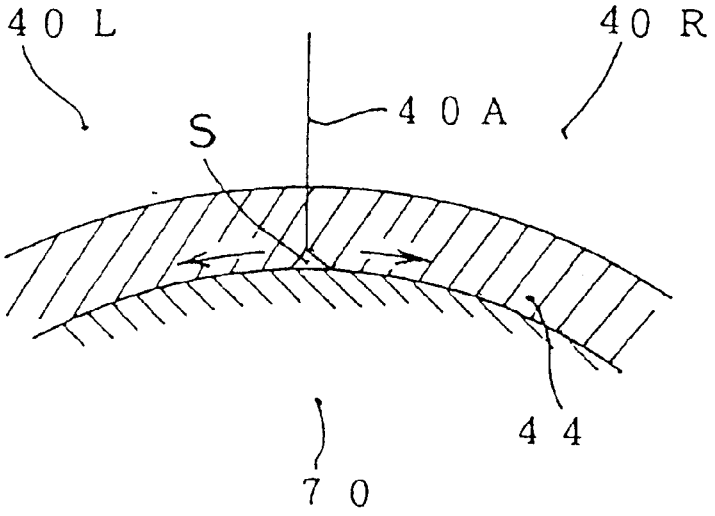

In case where the seal block pieces 40R, 40L are not provided with the sealing members 46 as shown in FIG. 6*b,* as bringing the seal block pieces 40R and 40L close to each other, the sealing members 44 first come into contact with the fixed dummy block 70 or the extruding stem 14, then the seal block pieces 40R and 40L are further close to each other, and come into sealing contact with each other. During this process, the sealing members 44 are pressed against the outer surface of the fixed dummy block 70 or the extruding stem 14 and move in the direction of arrows of FIG. 6*b*. Therefore, the sealing members 44 are deformed as shown in FIG. 6*b* due to the friction exerted from the outer surface of the fixed dummy block 70 or the extruding stem 14 so that spaces S are formed between the contact surfaces of the sealing members 44.

In case where the sealing members 46 made of sponge-like soft rubber (each 3 mm in thickness) are attached to the contact surfaces 40A of the seal block pieces 40R and 40L as shown in FIG. 6*a,* the sealing members 46 prevent the formation of the spaces S between the contact surfaces when the seal block is closed.

Figure 5:
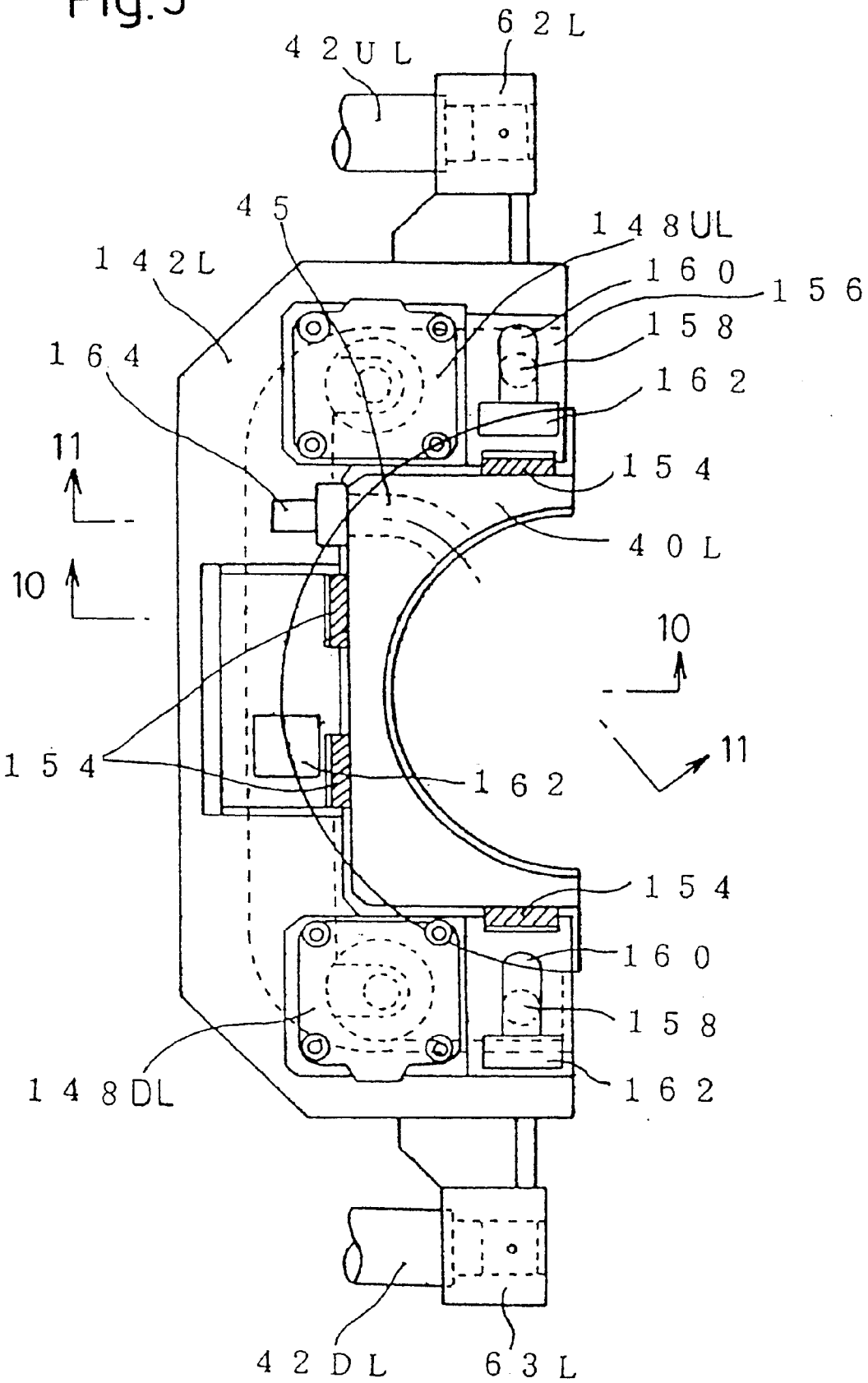
FIG. 5 is an enlarged partial front view of the seal block piece.
Figure 9:
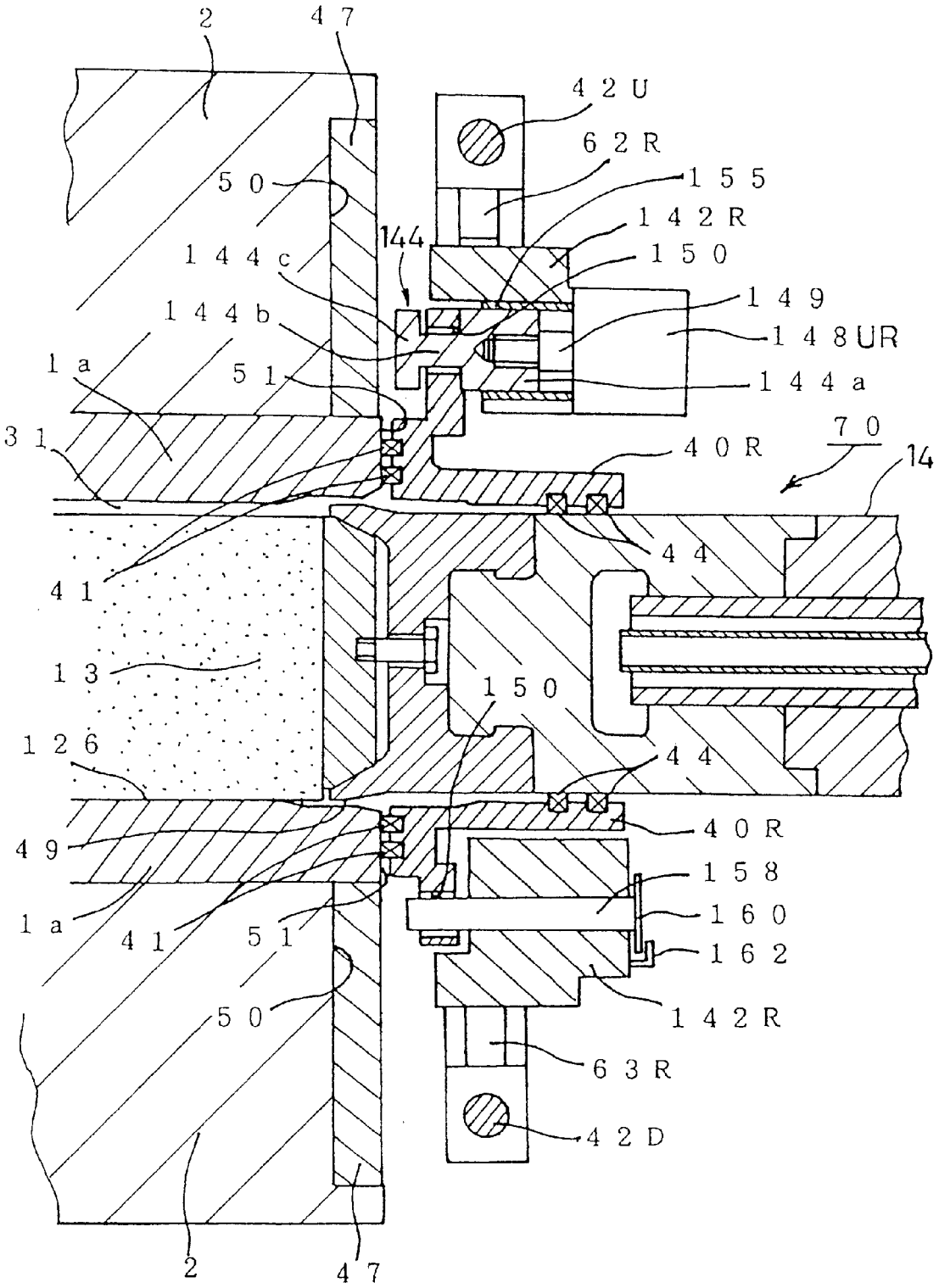
FIG. 9 is a sectional view taken along a line 9—9 of FIG. 2.
Figure 10:
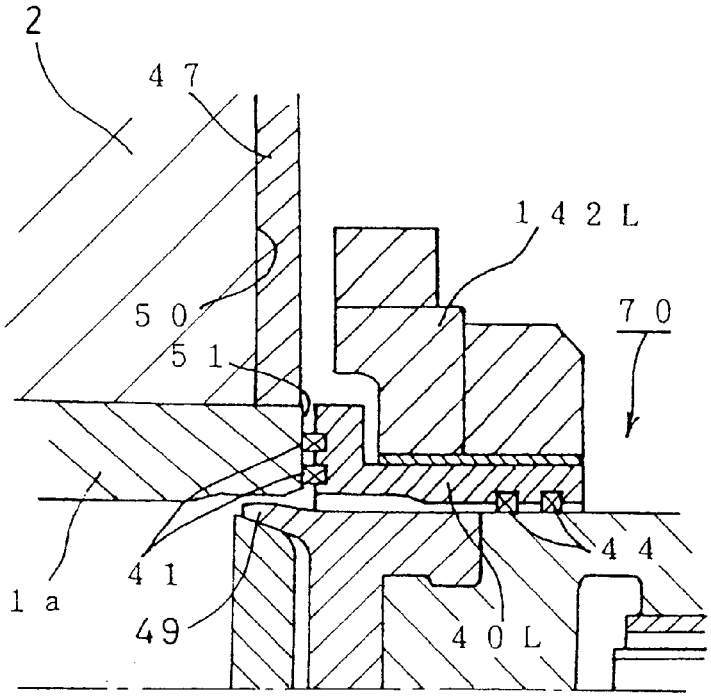
FIG. 10 is a sectional view taken along a line 10—10 of FIG. 5.

The description will now be made as regard to the structure of an operating device 140. The operating device 140 comprises the seal block pieces 40R and 40L, base pieces 142R, 142L (FIGS. 3, 5), press members 144 (FIGS. 9, 12*a,* 12*b*), and engaging pins 158 (FIG. 9). As shown in FIG. 5, the base pieces 142R and 142L, each having a configuration like a half of octagon, are surrounding the seal block pieces 40R and 40L as also shown in FIG. 9.

As shown in FIGS. 2, 3, and 9, the base pieces 142R, 142L are fixed to the upper guide legs 62R, 62L and the lower guide legs 63R, 63L, respectively. As shown in FIG. 3, each base piece 142R, 142L are provided with press cylinders 148UR and 148DR, 148UL and 148DL disposed on an upper portion and a lower portion thereof, respectively. As shown in FIG. 9, each press member 144 is threaded onto the tip of a cylinder rod 149 of each press cylinder. Each press member 144 comprises a base block 144*a,* a small-diameter portion 144*b,* and a press portion 144*c.*

Figure 17:
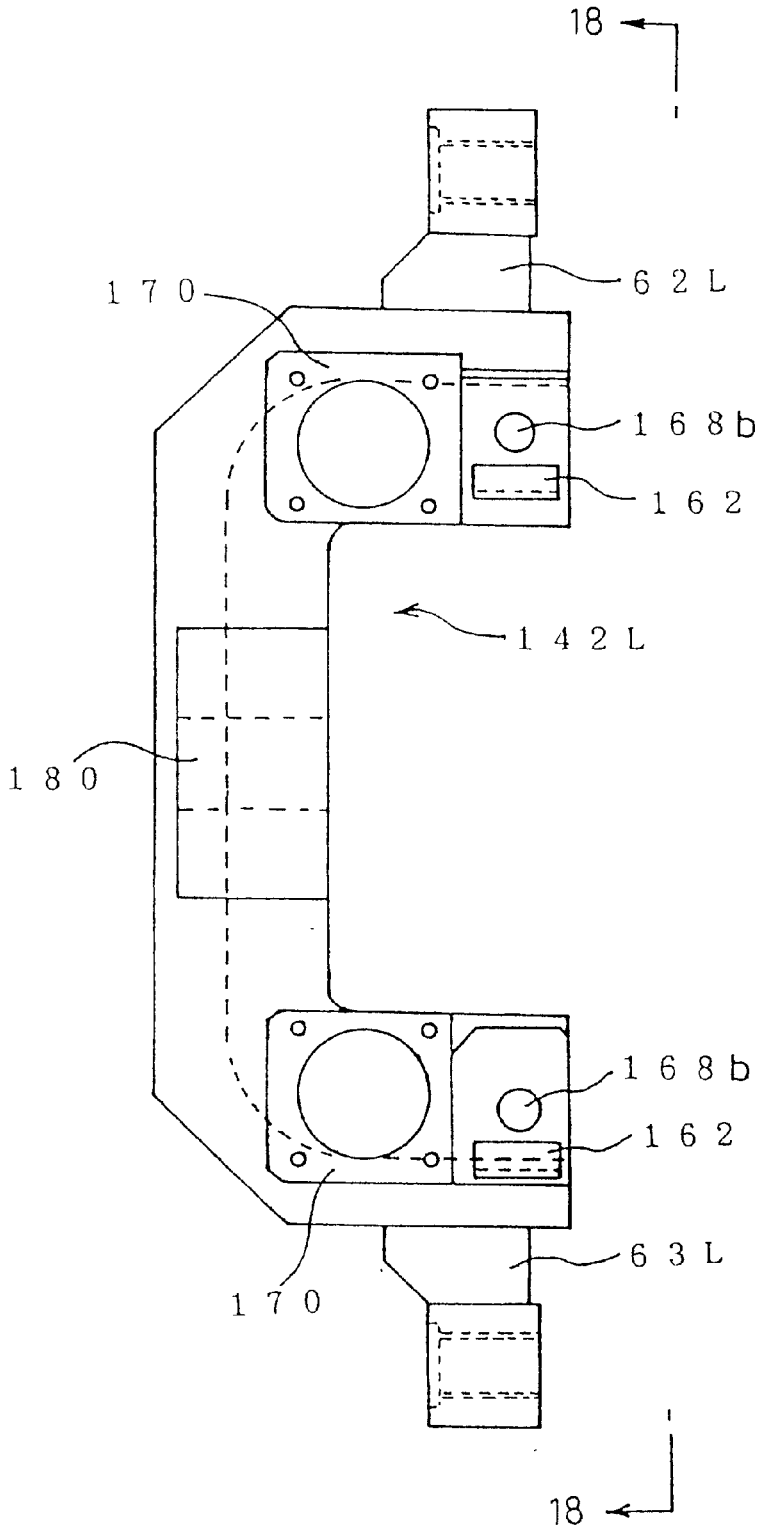
FIG. 17 is a front view of the seal block piece.
Figure 18:
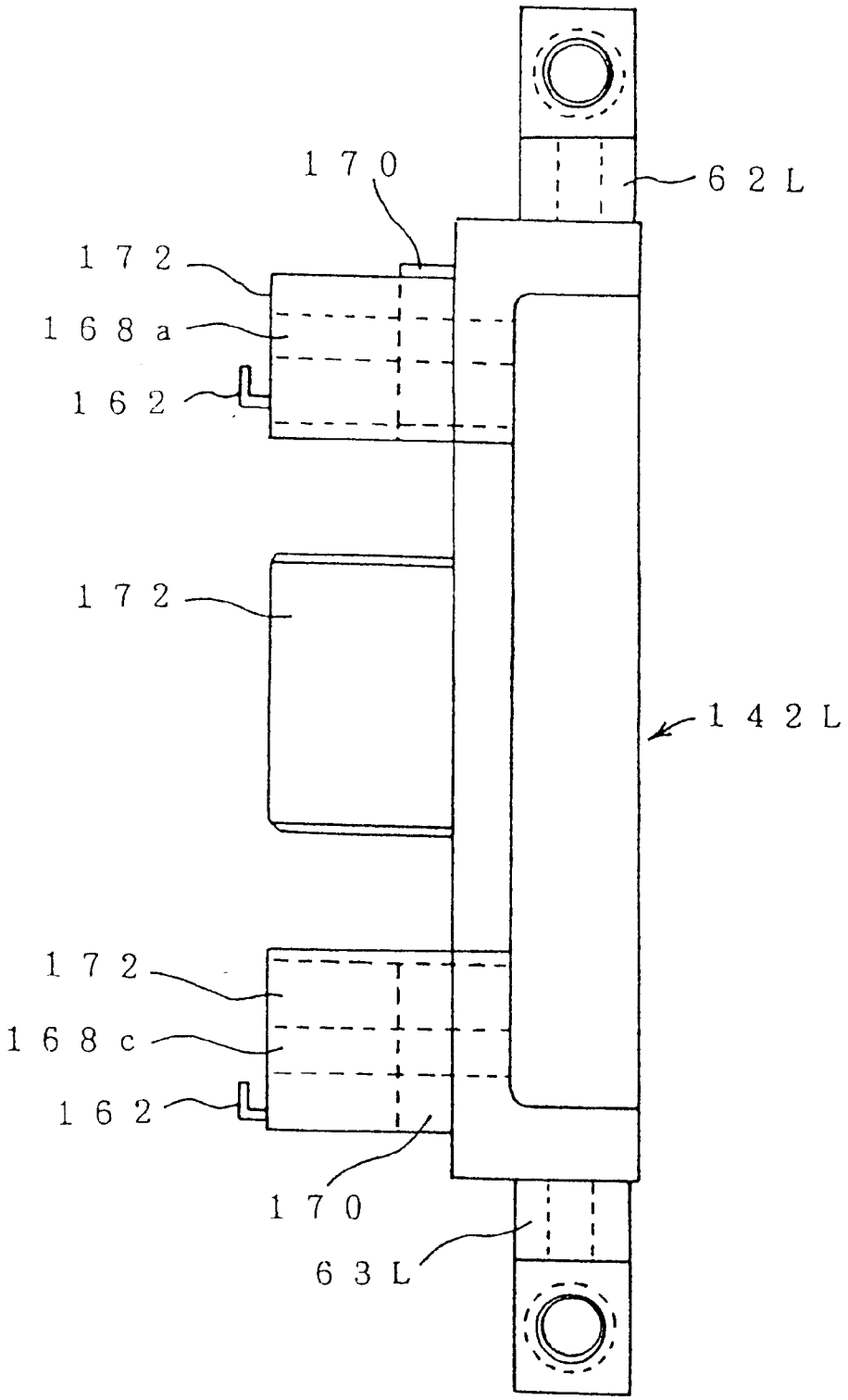
FIG. 18 is a side view taken along a line 18—18 of FIG. 17.

As shown in FIG. 17, each of the base pieces 142L and 142R constituting the seal block body has a substantially C-like configuration and is provided with cylinder beds 170 at the upper and lower portions thereof. The base pieces 142L and 142R are also each provided with pin mounting beds 172 each adjacent to the cylinder beds 170 as shown in FIG. 18. Sealing material holding blocks 58L, 58R (FIG. 19) are attached to the base pieces 142L, 142R, respectively by sliding them in the lateral direction. The engaging pins 158 each having a stopping plate 160 (FIG. 9) fixed on the end thereof are inserted into through holes 168*a* formed in the holding blocks 58L, 58R and holes 168*b* formed in the base pieces 142L, 142R and then turned by 90°, thereby engaging the stopping plates 160 to engaging portions 162 (FIG. 9) of the base pieces 142R, 142L. In this manner, the sealing material holding blocks 58L, 58R are fixed to the base pieces 142L, 142R.

Figure 21:
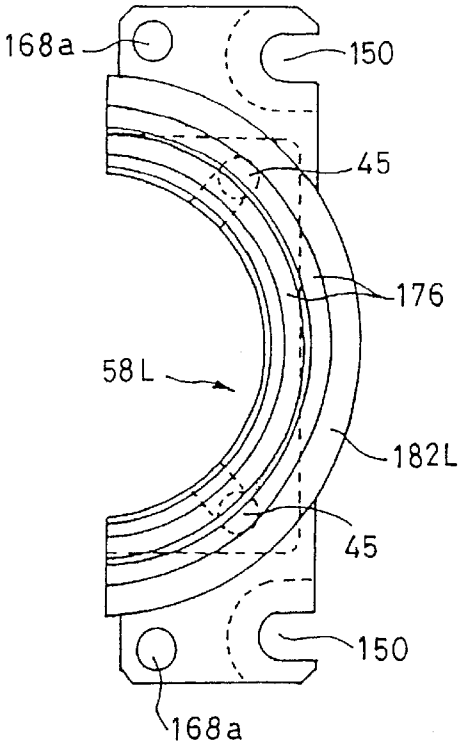
FIG. 21 is a front view taken along a line 21—21 of FIG. 20.
Figure 20:
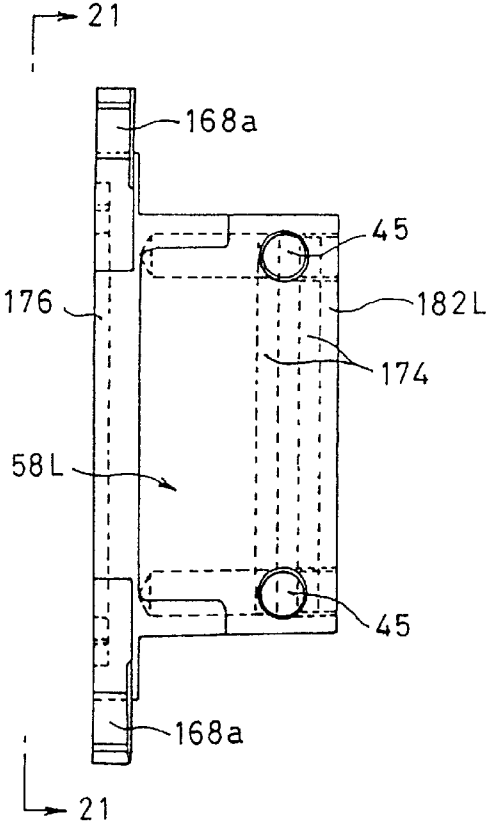
FIG. 20 is a side view taken along a line 20—20 of FIG. 19.
Figure 19:
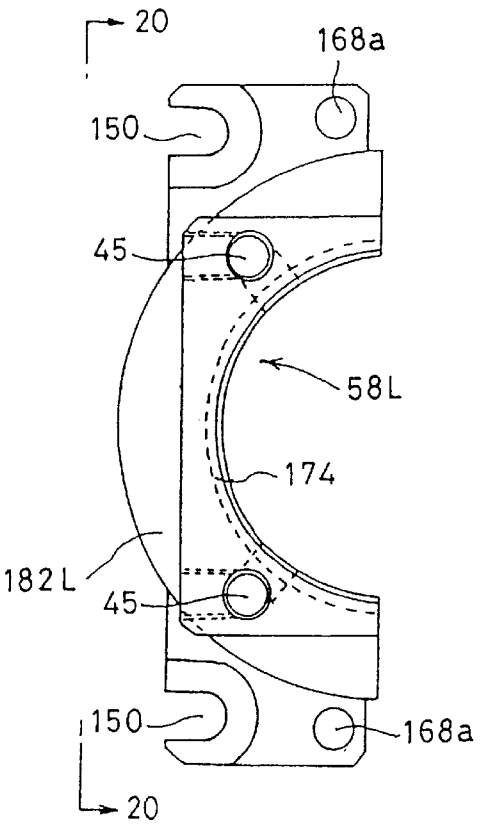
FIG. 19 is a front view of a sealing material holding block.

As shown in FIGS. 19 through 21, the sealing material holding blocks 58R, 58L are provided with grooves 174, 176 for mounting the sealing members 41, 44. Fitted in the grooves 174 are the sealing members 44 and fitted in the grooves 176 are the sealing members 41. Arranged on the sealing material holding blocks 58R, 58L are sealing material beds 182R, 182L each formed in a semicircular configuration fit to the outer surface of the fixed dummy block 70 or the extruding stem 14.

Figure 12A:
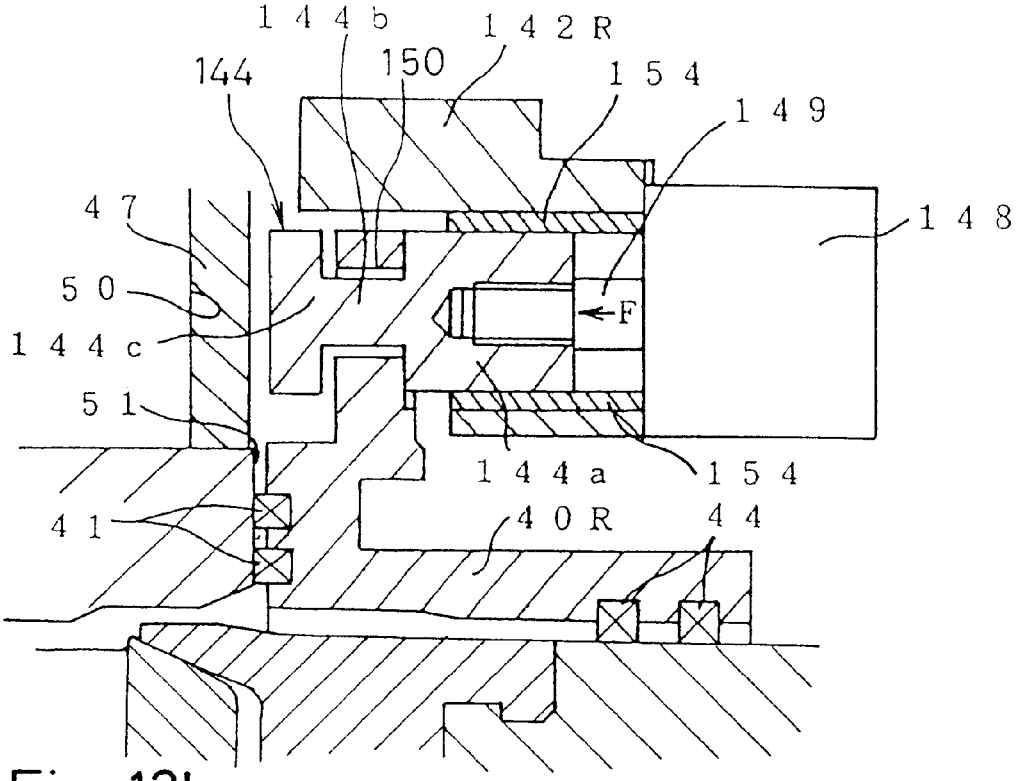
FIGS. 12*a* and 12*b* are views for explaining the conditions of bringing sealing members to or out of an end face of the container at the protrusion side by press members.
Figure 12B:
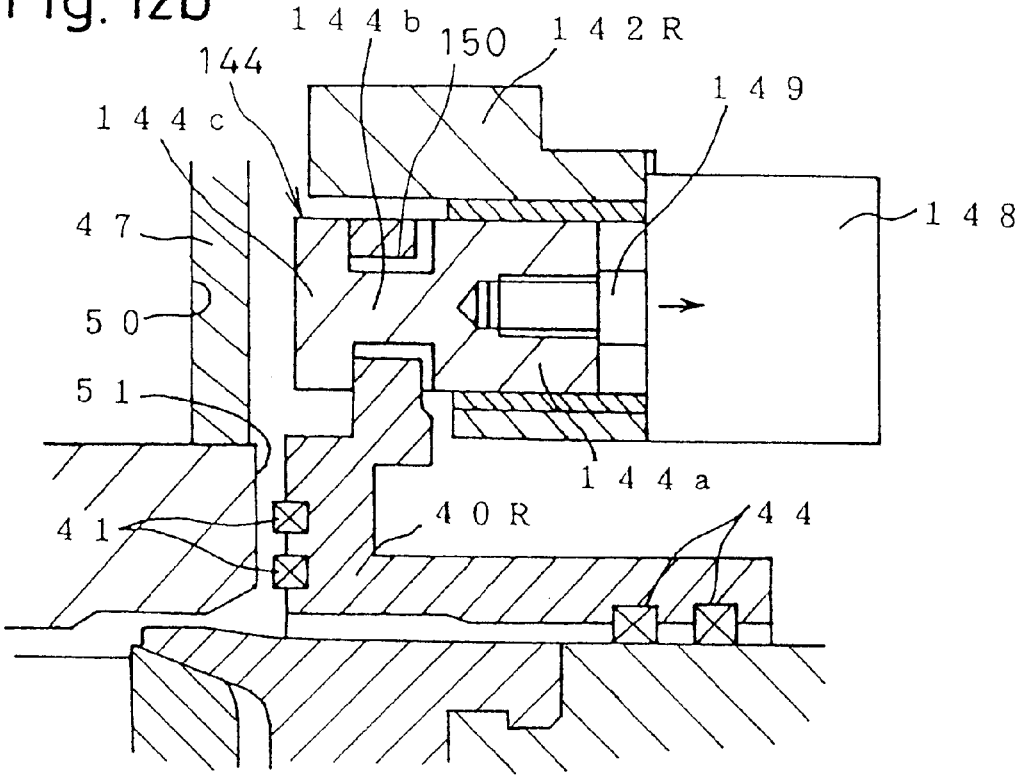

The sealing material holding blocks 58R, 58L are provided with notches 150 (FIGS. 9, 19) formed in both end portions thereof. For attaching and detaching the sealing material holding blocks 58L. 58R relative to the base pieces 142L, 142R in a short time, the small-diameter portions 144*b* of the press members 144 are engageable to the notches 150, respectively. As shown in FIGS. 12*a,* 12*b,* the press member 144 is exerted with pressure F developed by air pressure supplied and exhausted in the press cylinder 148 so that the base block 144*a* presses the seal block piece 40R, 40L to press the sealing members 41 against the end 51 of the container liner 1*a,* thereby providing high sealing performance.

Guide liners 154 are disposed for allowing the press members 144 to reciprocate smoothly between the base pieces 142R, 142L and the sealing material holding blocks 58R, 58L.

The sealing material holding blocks 58R, 58L and the base pieces 142R, 142L essentially constituting the seal block pieces 40R, 40L can be easily disassembled by pulling off the engaging pins 158. The replacing of the sealing material holding blocks 58R, 58L with spare ones is particularly frequently needed due to damage or wearing of the sealing members 41, 44, 46. Since the replacing of the sealing material holding blocks 58R, 58L can be completed, for example, only 3–4 minutes and then the extrusion can be successively proceeded, the yield of end products is little reduced.

Figure 11:
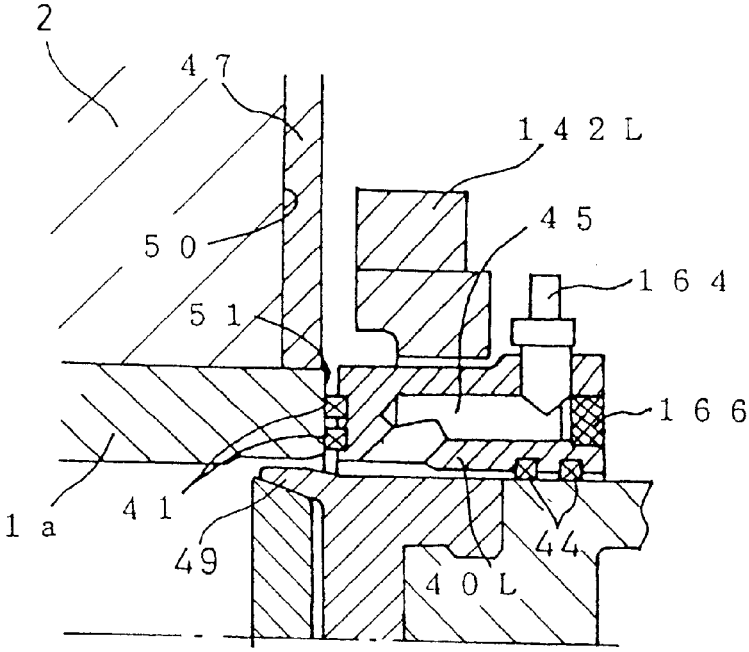
FIG. 11 is a sectional view taken along a line 11—11 of FIG. 5.

As shown in FIG. 11, for eliminate residual air in the space formed between the billet 13 and the container liner 1*a* to the outside the container when the billet 13 is loaded into the container 1, each seal block piece 40R, 40L is provided with a deaerating hole 45 in which a coupler 164 is arranged. A flexible pipe line 8*a* (FIGS. 1, 2) can be attached to the coupler 164. Reference numeral 166 designates a blind plug disposed on the way of the deaeration hole 45.

When the seal block pieces 40R, 40L return to the backmost positions thereof as shown by solid lines in FIG. 2, a billet loader 111 (described later) can move out and in with the billet 13 being placed thereon.

The deaerating hole 45 can communicate with a vacuum tank 20 through the flexible pile line 8*a,* an electromagnetic switch valve 90, and a fixed pile line 8*b.*

As shown in FIG. 9 and FIGS. 12*a,* 12*b,* the container tier 2 is provided with a circular concave portion 50 concentric with the container liner 1*a,* into which a donut-like heat insulator 47 is fitted. The heat insulator 47 has a function for reserving heat of the container. Since the sealing for the end face of the container 1 is achieved by a method of bringing the sealing members into sealingly contact with the end face of the container liner 1*a,* the seal block can be easily mounted to general purpose press machines.

Figure 13:
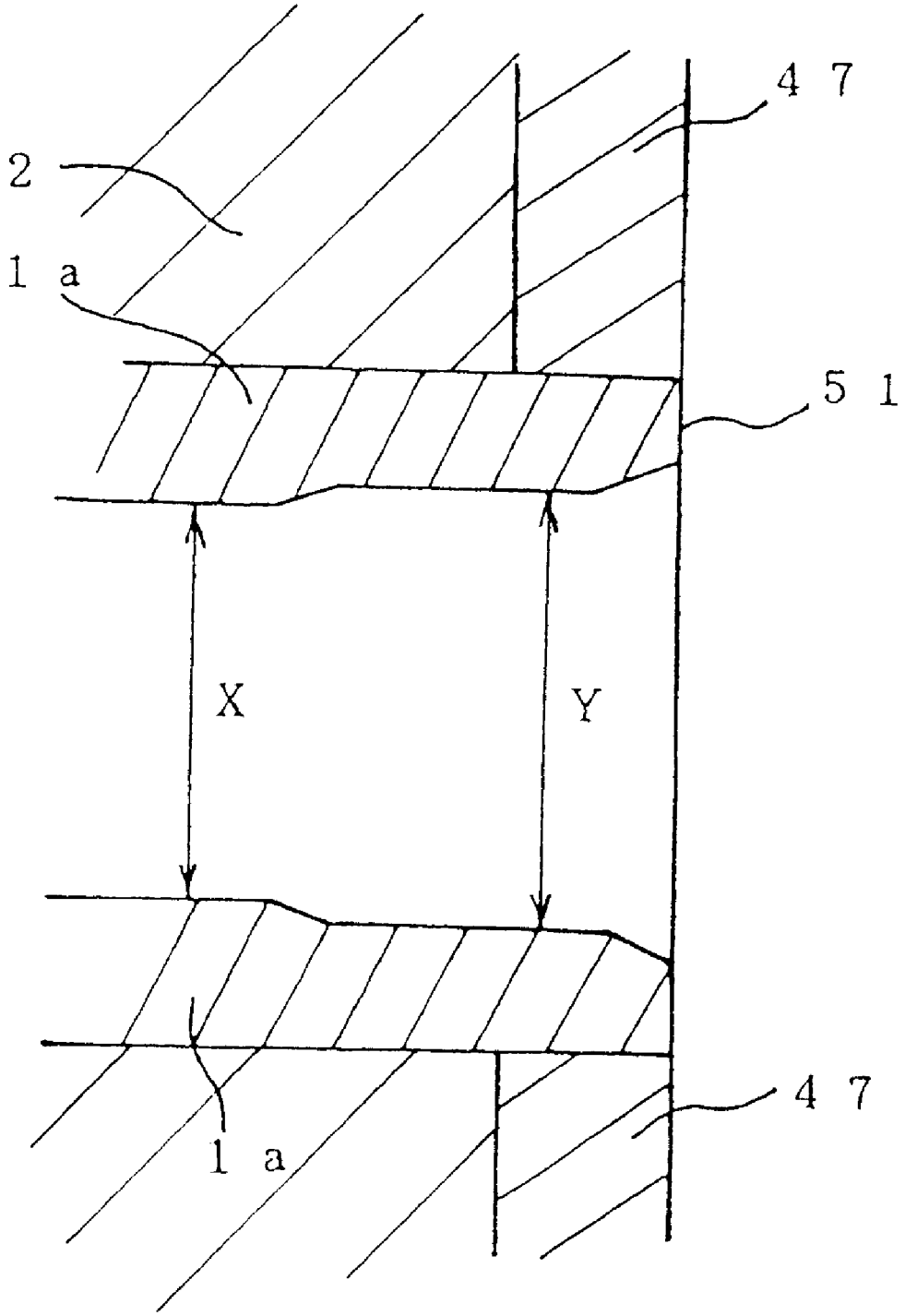
FIG. 13 is an enlarged sectional view of an inlet portion of the container.

As shown in FIG. 13, the inner diameter Y of a loading opening 126 of the container is larger than the inner diameter X of the container liner 1*a.*

Even when a tip large portion 49 of the fixed dummy block 70 is increased in diameter by aluminum residues adhering on the outer surface of the tip large portion 49 during extrusion so as to, for instance, have the same diameter as the inner diameter X of the container liner 1*a,* air within the container 1 can be easily eliminated because of an annular space formed between X–Y.

The entrance of the end face 51 of the container liner 1*a* is tapered in such a manner that its diameter is increased toward the end face so that the tip large portion 49 of the fixed dummy block 70 can smoothly pass and press the billet 13 into the container 1 from the end face of the extruding stem 14.

Figure 14A:
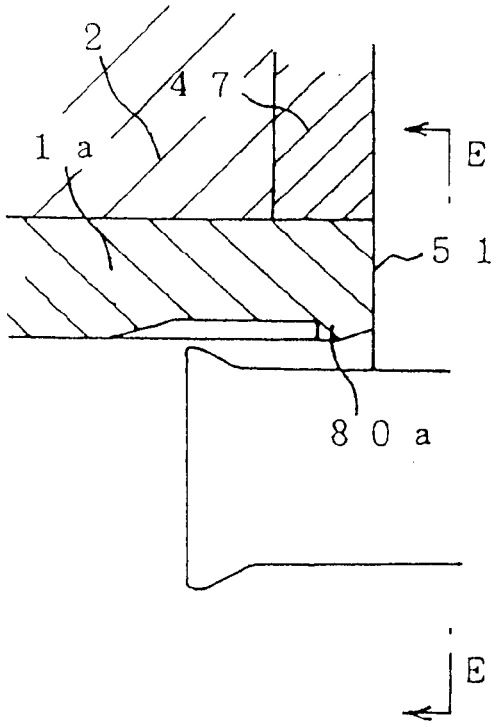
FIGS. 14*a* and 14*b* are enlarged sectional views illustrating various kinds of configurations for the inlet portion of the container.
Figure 14B:
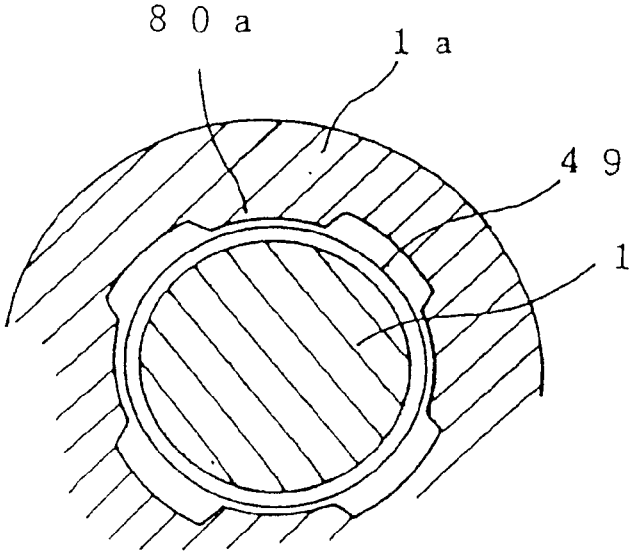

As shown in FIGS. 14*a* and 14*b,* the inner surface of the entrance of the container liner 1*a* at the end face 51 may be provided with protrusions 80*a.*

There is no cover plate nor guide rail for the close/open motion of the seal block pieces 40R, 40L. This is because the seal block pieces 40R, 40L are opened with the guide rods 42U, 42D being guided by the through pipes 64UL, 64UR, 64DL, 64DR.

Figure 7A:
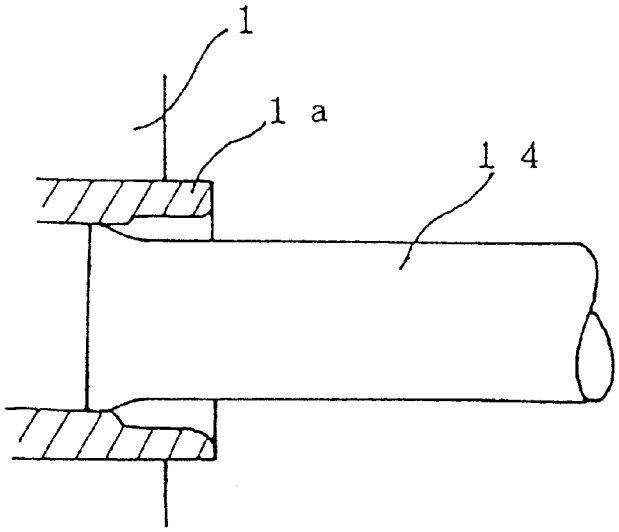
FIGS. 7*a* and 7*b* are views for explaining the conditions of scrapping off aluminum residues stuck on the inner surface of the container liner.
Figure 7B:
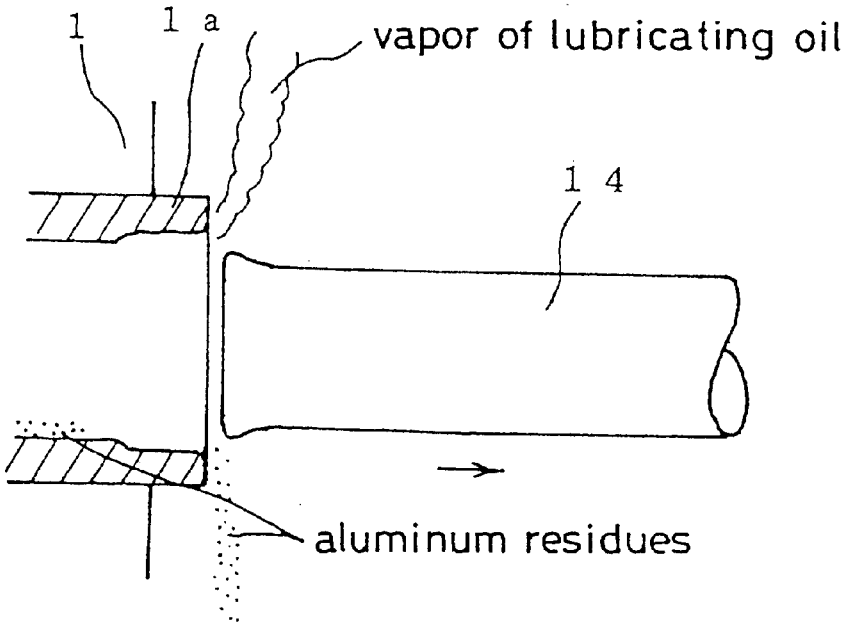

The above structure facilitates the exchange of the container tire 2 and the container liner 1*a*. In addition, in case of scrapping off aluminum residues stuck on the inner surface of the container liner 1*a* by the outer surface of the fixed dummy block 70 when the extruding stem 14 returns to the original position after extruding the billet 13, the scrapped aluminum residues just fall down from the end face 51 of the container liner 1*a* as shown in FIG. 7. The residues do not enter into a groove of the guide plate as the prior art. Therefore, the close motion of the seal block pieces 40R, 40L is always well and the sealing performance is also well.

The description will be made as regard to the billet loader 111 with reference to FIG. 2 and FIG. 8.

Figure 8:
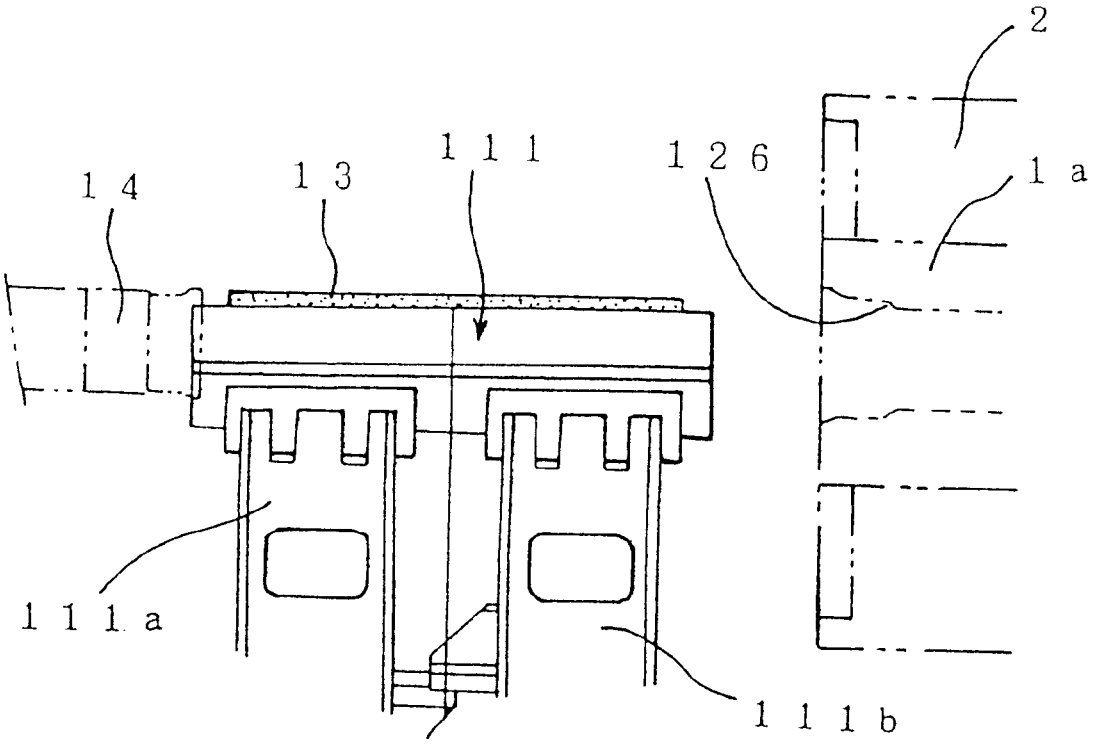
FIG. 8 is a front view of a billet loader.

The billet loader 111 shown in FIG. 2 and FIG. 8 comprises a first billet loader 111*a* and a second billet loader 111*b* for supplying the billet 13 as an extrusion material to the loading opening 126 of the container 1. The billet 13 sent by a billet carrier (not shown) disposed at either side of the extruder is clamped one by one and lifted to the level of the loading opening 126.

The billet loader 111 is disposed to face the billet carrier and is provided with a swing arm 128 which is pivotable along a plane perpendicular to the extruding axis of the extruder.

One end of the swing arm 128 is pivotally mounted to a central shaft 130 disposed outside a lower tight rod 129 of the extruder. The swing arm 128 is bent in a V-like shape with a high angle to prevent interference with the tight rod 129 during swinging and extends from a position below the lower tight rod 129 toward a lower portion of the container 1. The other end of the swing arm 128 reciprocates between the board (not shown) of the billet carrier and the loading opening 126 of the container 1 by the pivotal movement of the swing arm 128.

The swing arm 128 is connected to a hydraulic cylinder 132 which drives the swing arm 128 by its rectilinear motion.

The other end of the swing arm 128 is provided with a billet holder 133 for clamping the billet 13. The billet holder 133 has beds 134 for supporting the bottom of the billet 13 in a loading position.

As for the structure of the extruding stem 14, there are two cases: where the fixed dummy block 70 and the extruding stem 14 are connected through a bayonet block 72, that is, "bayonet connection" and where the fixed dummy block 70 is directly connected to the extruding stem 14 by screwing.

The bayonet connection is employed in this embodiment.

The fixed dummy block 70 is fixed to the front surface of the extruding stem 14 and slidably disposed in the container 1. The rear end of the extruding stem 14 is fixed to a cross head 75 through a stem holder 73 and a pressure ring 74 as shown in FIG. 1.

The bayonet block 72 is disposed on the front surface of the extruding stem 14. The tip of a connection rod 76 having a circular section is screwed into the rear half of the bayonet block 72. The rear end of the connection rod 76 is a large-diameter portion 76*a* which is fixed to a hole formed in the rear end portion of the extruding stem 14 in such a manner that tapered surface therebetween are engaged each other.

Hereinafter, the deaerating method will be described with reference to FIG. 15 and FIGS. 16*a*–16*d*. As shown in FIG. 1, the piston 37 is first moved in the left direction by supplying pressure oil to a rod side of the container cylinder 33 to advance the container 1, which is now spaced apart from the die 3, so that the container 1 comes into contact with the die 3.

After that, the billet loader 111, on which the billet 13 is now placed, rises up to hold the billet 13 at the central position. As the extruding stem 14 is advanced ((1) of FIG. 15, FIG. 16*a*), the billet 13 is pressed into the container 1 (FIG. 16*b*). The inside of the vacuum tank 20 is already vacuum state, e.g. 0–5 Torr, by the vacuum pump 21. The billet 13 is pressed into the container 1 according to the advance of the extruding stem 14. The extruding stem 14 stops for a moment where the tip large portion 49 of the fixed dummy block 70 reaches the large-diameter portion of the entrance of the container liner 1*a*.

Figure 15:
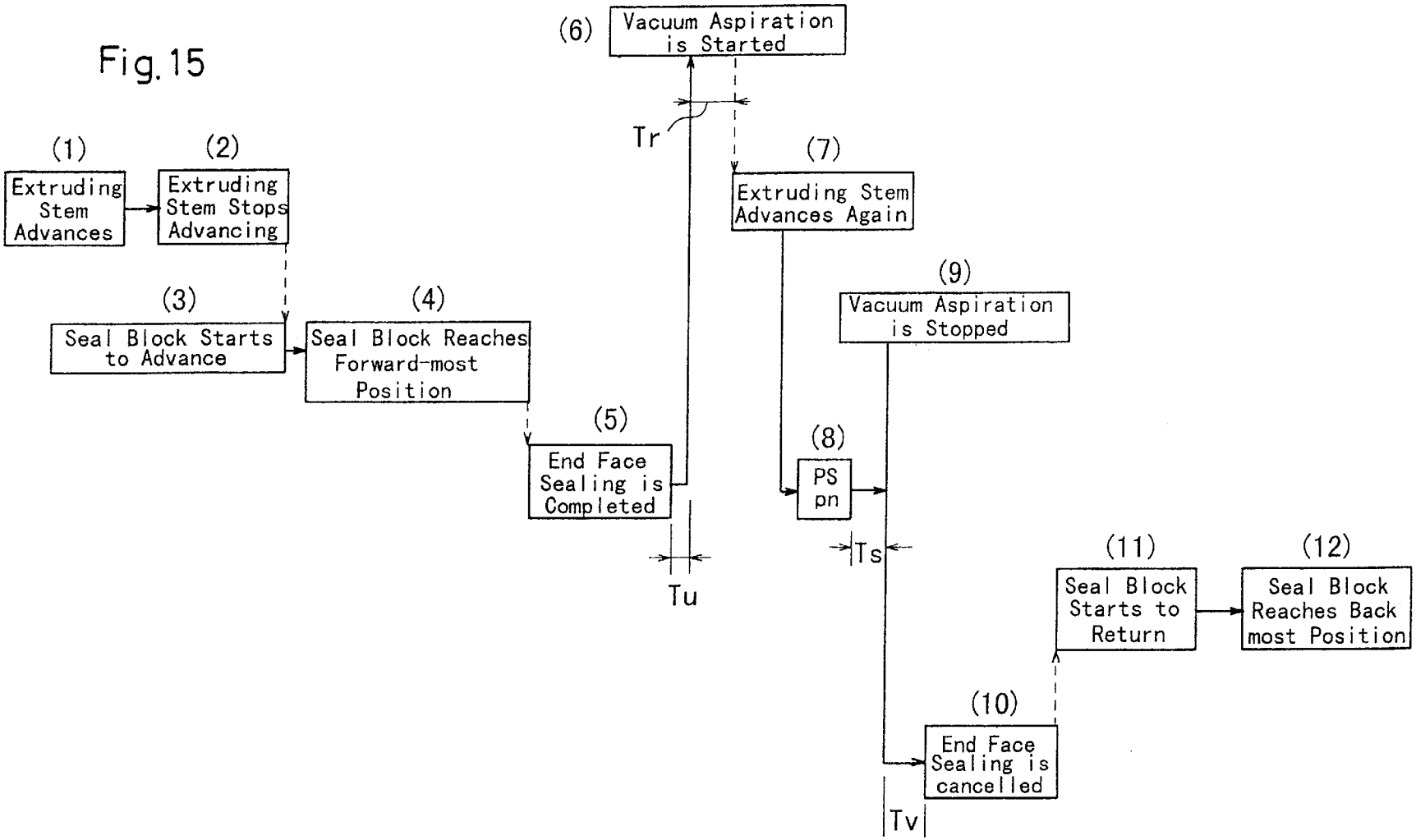
FIG. 15 is a flow chart showing controlling procedure with time.
Figure 16A:
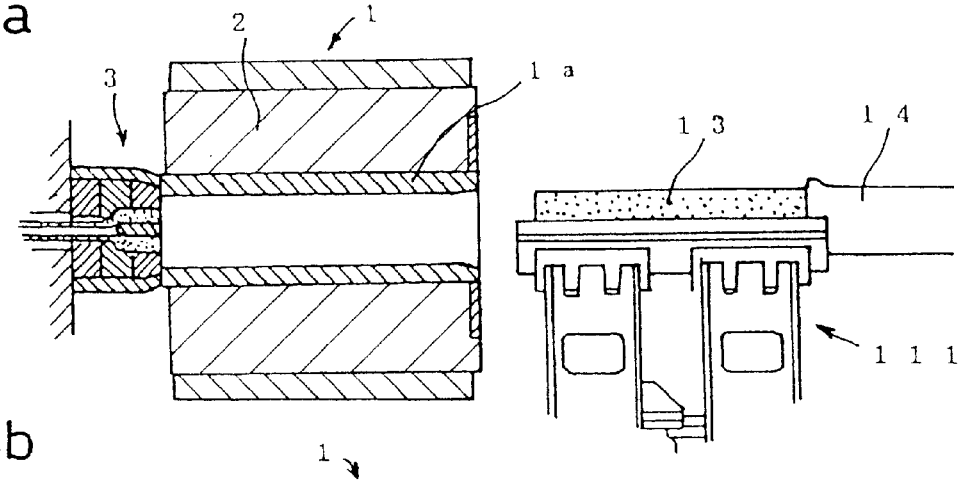
FIGS. 16*a,* 16*b,* 16*c,* and 16*d* are views for explaining the conditions of pushing and extruding the billet loaded into the container.
Figure 16B:
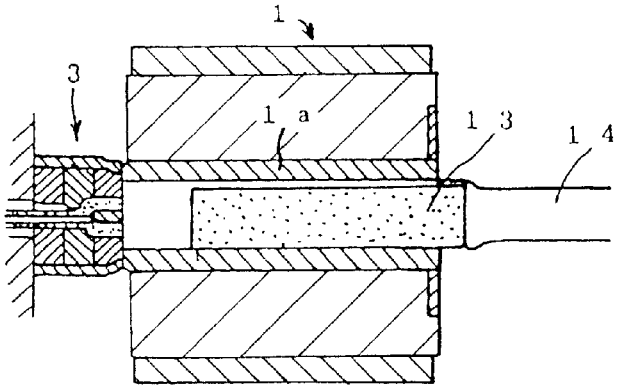
Figure 16C:
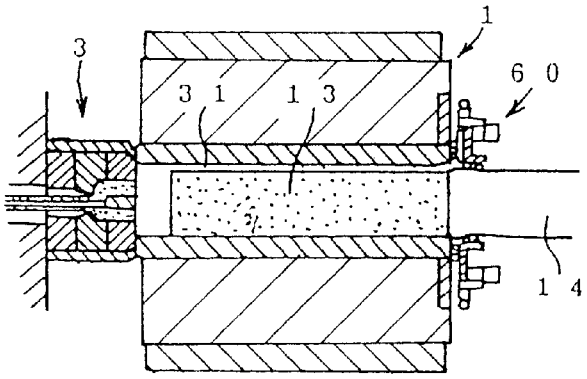

At the same time when the extruding stem 14 stops for a moment ((2) of FIG. 15), the cylinders 43 are actuated to start the advance movement of the seal block pieces 40L, 40R ((3) of FIG. 15). The seal block pieces 40L, 40R are advanced to the forward-most positions so as to bring the sealing members 44 into contact with the outer surface of the extruding stem 14. In this state, the close motion of the seal block pieces 40L, 40R is performed ((4) of FIG. 15, FIG. 16*c*). The sealing members 41 are strongly pressed against the end face 51 of the container liner 1*a* by the press members 144, thereby sealing the container 1 relative to the extruding stem 14. The deaeration space 31 between the container 1, the die 3, and the billet 13, therefore, communicates with the vacuum aspirator 60 ((5) of FIG. 15).

The deaeration is not started simultaneously with the sealing. The vacuum aspirator 60 is actuated after Tu seconds (about 0.2 seconds) from the sealing by using a timer (not shown) to excite the electromagnetic switch valve 90, thereby starting the vacuum aspiration in a state allowing the communication between the inside of the container 1 and the vacuum tank 20 ((6) of FIG. 15). Air in the sealed space flows through the deaerating holes 45 of the seal block pieces 40L, 40R and is vacuumed into the vacuum tank 20 through the pipe line 8*a*, the electromagnetic switch-valve 90, and the pipe line 8*b*. Once the electromagnetic switch valve 90 is excited, residual air in the container 1 is vacuumed by the vacuum tank 20 and, just after 0.2–0.5 seconds, the inside of the container 1 becomes 5–30 Torr. In this manner, the residual air in the container can be quickly and sufficiently exhausted.

Figure 16D:
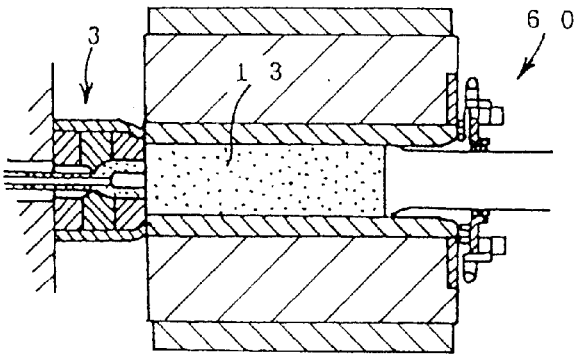

The extruding stem 14, which has been stopped, is advanced again ((7) of FIG. 15) after Tr seconds (about 0.2–0.3 seconds) from the start of the vacuum aspiration by the vacuum aspirator 60, using the timer (not shown). The re-advance of the extruding stem 14 causes the billet 13 loaded in the container 1 to be pressed so that the distal end of the billet 13 comes into contact with the die 3. When the hydraulic pressure in the side cylinder becomes a predetermined value, the press working changed to a main cylinder (not shown). Thus, the upsetting is completed (FIG. 16*d*). The rear end of the billet 13 is squeezed because the advance of the billet 13 is blocked by die 3. Following that the extrusion will be started.

The pressure in the container 1 rises up until the completion of the upsetting. As the pressure in the container 1 exceeds the preset pressure of the pressure switch PS (not shown) ((8) of FIG. 15), the timer (not shown) starts to count Ts seconds (about 5–6 seconds) and after Ts seconds the vacuum aspiration in the container 1 by the vacuum aspirator 60 is stopped ((9) of FIG. 15). After stopping the vacuum aspiration, the timer starts to count Tv seconds (about 0.2 seconds). After Tv seconds, the press members 144, which strongly press the sealing members 41 arranged on the end face of the seal block pieces 40R, 40L against the end face of the container liner 1*a* with the protrusions 80, is moved backward to cancel the sealing between the extruding stem 14 and the container 1 ((10) of FIG. 15).

At the same time of the backward movement of the press members 144, the seal block pieces 40R, 40L are started to be returned ((11) of FIG. 15). The seal block pieces 40R, 40L are returned to the original positions and are stopped ((12) of FIG. 15).

During this operation, the forward movement of the extruding stem 14 is continued without stopping so that the billet 13 is squeezed. After that, the extrusion by the extruding stem 14 is still continued. Upon completion of the extrusion, the extruding stem 14 is returned to start a next extrusion cycle.

When the sealing members 41, 44, 46 are damaged or wear away so that they can not provide predetermined degree of vacuum, the sealing material holding blocks 58R, 58L should be quickly replaced with spare ones. In this case, each stopping plate 160 is turned to the position, where it can be removed from the engaging portion 162, and then took away. After that, the sealing material holding block 58R (or 58L) damaged is removed and a spare sealing material holding block 58R (or 58L) is inserted in such a manner that the sealing material holding block 58R (or 58L) is superposed on the base plate 142R (or 142L). Then, each engaging pin 158 is inserted and each stopping plate 160 is turned to be engaged to the engaging portion 162. In this manner, the extrusion of billet 13 by advance of the extruding stem 14 can be started again.

As apparent also from the above description, the present invention has the following effects.

(1) The two-piece seal block arranged on the end face, at the extruding stem side, of the container is closed in a direction perpendicular to the axial direction of the extruding stem and the press member further strongly presses the sealing material against the end face of the protrusion of the container, thereby making the sealing performance higher and providing sufficient deaeration, without making the whole length of the extruder longer.

(2) The inside of the container can be sufficiently deaerated before the extrusion, thereby providing end products without blow hole of air and thus improving the quality and yield of end products.

(3) The sealing by the seal block is performed in a short time, thereby reducing the idle time.

(4) The seal block is spaced apart from the ring-like protrusion and the extruding stem until the time immediately before the seal block is closed, thereby making the lives of the sealing members longer.

(5) Even when aluminum residues are scrapped off by the outer surface of the fixed dummy block when the extruding stem is returned to the original position after extruding the billet, the scrapped aluminum residues just fall down out of the container, not enter into such a groove along which the two-piece block is opened as the prior arts, thereby keeping the higher sealing performance.

(6) This structure does not require the verp cycle as the prior art, thereby reducing the idle time.

(7) Even when the sealing members for keeping the degree of vacuum are damaged or wear away and are thus needed to be replaced, time for replacing them is short, thereby preventing the deterioration of the yield of end products.

What is claimed is:

1. An extruder comprising, a container having a container liner therein adapted to receive a billet therein, an extrusion stem for disposing the billet into the container, a two-piece seal block installed between the container and the extrusion stem for sealing therebetween, said seal block being formed of two seal block sections for sandwiching the extrusion stem therebetween, each seal block section including a base piece having a press member, and a holding block detachably attached to the base piece to be moved by the press member and having a first sealing member facing the extrusion stem and a second sealing member facing the container, and moving means attached to the seal block sections for moving the seal block sections relative to the extrusion stem, each of said holding block being urged to the extrusion stem by the moving means and to the container by the press member to thereby seal between the container and the extrusion stem.

2. An extruder according to claim 1, wherein each seal block section further includes engaging pins for detachably connecting the holding block to the base piece.

3. An extruder according to claim 2, wherein said base piece includes engaging pieces, each engaging pin having a stopping plate at one end engageable with one of the engaging pieces.

4. An extruder according to claim 2, wherein said second sealing member orients perpendicular to the first sealing member and contacts the container liner.

5. An extruder according to claim 4, further comprising a vacuum aspirator attached to the seal block for vacuum aspiration inside the container liner when the extrusion stem and the container are sealed by the seal block for extrusion.

6. An extruder according to claim 4, further comprising guide liners disposed between the holding block and the base piece for smoothly moving the holding block relative to the base piece.

* * * * *